US009540216B2

(12) United States Patent
Paβmann et al.

(10) Patent No.: US 9,540,216 B2
(45) Date of Patent: Jan. 10, 2017

(54) CRANE HAVING A TRUSS GIRDER WITH FLATTENED BRACES

(71) Applicant: Terex MHPS GmbH, Düsseldorf (DE)

(72) Inventors: Christoph Paβmann, Dortmund (DE); Richard Kreisner, Ennepetal (DE); Michael Karden, Wetter (DE); Thomas Schlierbach-Knobloch, Herdecke (DE)

(73) Assignee: TEREX MHPS IP MANAGEMENT GMBH, Dusseldorf (DE)

( * ) Notice: Subject to any disclaimer, the term of this patent is extended or adjusted under 35 U.S.C. 154(b) by 27 days.

(21) Appl. No.: 14/388,596

(22) PCT Filed: Mar. 28, 2013

(86) PCT No.: PCT/EP2013/056763
§ 371 (c)(1),
(2) Date: Sep. 26, 2014

(87) PCT Pub. No.: WO2013/144314
PCT Pub. Date: Oct. 3, 2013

(65) Prior Publication Data

US 2015/0053636 A1 Feb. 26, 2015

(30) Foreign Application Priority Data

Mar. 30, 2012 (DE) ..... 10 2012 102 808

(51) Int. Cl.
*B66C 19/00* (2006.01)
*B66C 6/00* (2006.01)
(Continued)

(52) U.S. Cl.
CPC ..... *B66C 6/00* (2013.01); *B66C 19/00* (2013.01); *E04C 3/09* (2013.01); *E04C 2003/0491* (2013.01)

(58) Field of Classification Search
CPC ..... B66C 6/00; B66C 19/00; E04C 3/09; E04C 2003/0491
(Continued)

(56) References Cited

U.S. PATENT DOCUMENTS 327,360 A 9/1885 Vanes
4,621,475 A 11/1986 McClain
(Continued)

FOREIGN PATENT DOCUMENTS

CN 201932820 8/2011
DE 260030 5/1913
(Continued)

OTHER PUBLICATIONS

English Translation of International Preliminary Report on Patentability for corresponding PCT Application No. PCT/EP2013/056763, mailed Jul. 10, 2013.
(Continued)

*Primary Examiner* — Emmanuel M Marcelo
*Assistant Examiner* — Michael Gallion
(74) *Attorney, Agent, or Firm* — Gardner, Linn, Burkhart & Flory, LLP

(57) ABSTRACT

The invention relates to a crane, particularly a bridge crane or gantry crane, including at least one crane girder extending horizontally and designed as a truss with a plurality of braces, on which girder a crane trolley with a lifting gear is movable. At least some of the braces have a flat shape. The flat-shaped braces each have a flat main surface that extends in each case transversely to a longitudinal direction of the crane girder.

20 Claims, 7 Drawing Sheets

(51) Int. Cl.
*E04C 3/09* (2006.01)
*E04C 3/04* (2006.01)

(58) Field of Classification Search
USPC ..... 212/324
See application file for complete search history.

(56) References Cited

U.S. PATENT DOCUMENTS

| | | | | |
|---|---|---|---|---|
| 5,195,204 | A * | 3/1993 | Muller | E01D 21/105 14/4 |
| 7,503,460 | B1 * | 3/2009 | Petricio Yaksic | B66C 5/02 104/126 |
| 2004/0056493 | A1 * | 3/2004 | Vanagan | B66C 1/105 294/67.21 |
| 2005/0055951 | A1 | 3/2005 | Ollman | |
| 2011/0247993 | A1 * | 10/2011 | Chernyak | B66C 6/00 212/324 |
| 2014/0000472 | A1 * | 1/2014 | Schlierbach-Knobloch | B66C 9/08 104/106 |

FOREIGN PATENT DOCUMENTS

| | | |
|---|---|---|
| DE | 1095486 | 12/1960 |
| DE | 1971794 | 11/1967 |
| DE | 1907455 | 10/1969 |
| DE | 1759120 | 6/1971 |
| DE | 3109834 | 1/1982 |
| DE | 3222307 | 12/1983 |
| DE | 102012102808 | 3/2012 |
| FR | 1391167 | 1/1965 |
| JP | 2006299534 | 11/2006 |
| KR | 20110020286 | 3/2011 |

OTHER PUBLICATIONS

International Search Report for corresponding PCT Application No. PCT/EP2013/056763 dated Jul. 10, 2013.
Written Opinion for corresponding PCT Application No. PCT/EP2013/056763.

* cited by examiner

CRANE HAVING A TRUSS GIRDER WITH FLATTENED BRACES

BACKGROUND OF THE INVENTION

The present invention relates to a crane, in particular a bridge crane or gantry crane, which includes at least one crane girder that extends horizontally and is designed as a truss with a plurality of braces, on which girder a crane trolley with a lifting gear is movable.

German patent specification DE 260030 discloses a so-called double-girder gantry crane comprising two horizontal crane girders and two vertical support girders that form a gantry frame of the gantry crane. The crane girders extend in parallel and at a spaced interval with respect to one another. Arranged at lower ends of the support girders is in each case a travelling mechanism, by means of which the gantry crane is movable in a direction of travel extending transversely with respect to the longitudinal direction of the crane girders. A crane trolley having a cable winch is movable on and along the crane girders. In accordance with the design as a double-girder crane, a load picking-up means of the cable winch arranged on the crane trolley is lowered or raised between the two crane girders. The crane girders are designed as trusses and each comprise an upper boom and a lower boom that are each oriented horizontally and in parallel with one another. The upper and lower booms of the two crane girders are connected to one another by means of vertically extending, bar-shaped posts and diagonally extending, bar-shaped posts. At their ends, the two crane girders are connected to one another by means of crossbars and braces to form a frame. Bar-shaped posts and braces are provided along the longitudinal direction of the crane girders between the upper boom and the lower boom in the manner of a truss, which posts and braces each connect an upper boom to the lower boom arranged vertically therebelow.

German utility model document DE 1 971 794 U describes a double-girder bridge crane, whose two horizontal crane girders are connected to one another by means of head girders arranged at respective ends thereof and are movable together in a direction of travel extending transversely with respect to the longitudinal direction of the crane girders. Both crane girders are similarly designed as trusses and each comprise plate-shaped upper booms, bar-shaped lower booms and bar-shaped posts.

Patent specification DE 31 09 834 C2 relates to a tower crane having a mast and a crane jib that are designed as truss constructions. The cuboidal mast comprises four L-shaped and vertically oriented support girders, of which in each case two adjacent support girders are connected to one another by means of triangular plates. In this case, the plates are fastened with their corner regions and/or one of their sides to the support girders. At least some of the sides of the plates are folded and form stiffening ribs.

Furthermore, German laid-open document DE 1 759 120 A already discloses a crane girder that in a typical manner comprises an upper boom and a lower boom that are stiffened in the manner of a truss and by means of panels and are connected to one another. The panels are in the shape of a symmetrical trapezium and consist of sheet panels having bent outer contour edges. Two openings are also provided in the panel to reduce weight.

A further German laid-open document DE 1 907 455 A discloses a truss, whose upper boom and lower boom are connected by means of braces, which are formed in one piece from a flat profile extending in zigzag fashion. The flat profile has an angular, wavelike or channel-shaped cross-section.

Furthermore, U.S. Pat. No. 4,621,475 B already discloses a truss, whose braces are also designed as flat profiles that are folded back on both sides outside the ends. The thus flat ends of the braces are welded to upper and lower booms of the truss and the flat profiles extend on the whole in a vertical plane and in parallel with the longitudinal extension of the truss.

Laid-open document US 2005/0055951 A1 also discloses a further truss, whose braces comprise between the upper boom and the lower boom a cross-section that changes starting from the ends of the braces to the centre thereof.

German patent specification DE 1 095 486 B discloses a crane girder that is designed as a truss and comprises T-profiles as braces.

Furthermore, Chinese utility model CN 201 932 820 U and Korean patent application KR 2011 0020286 A disclose crane girders designed as box girders.

SUMMARY OF THE INVENTION

The present invention provides a crane, in particular a bridge crane or gantry crane, having at least one improved crane girder.

According to one aspect of the invention a crane, in particular a bridge crane or gantry crane, includes at least one crane girder that extends horizontally and is designed as a truss with a plurality of braces, on which girder a crane trolley with a lifting gear is movable, wherein at least some of the braces are designed having a flat shape. The at least one crane girder is advantageously improved by designing at least some of the braces to have a flat shape, the flat-shaped braces each having a planar main surface that extends in each case transversely with respect to a longitudinal direction of the crane girder, the flat-shaped braces having an elongated shape and include, in the region of their longitudinal sides, in each case at least one folded auxiliary surface that adjoins the main surface and the at least one auxiliary surface points transversely with respect to the longitudinal direction of the crane girder. The braces have opposite brace ends, the auxiliary surfaces are arranged outside the brace ends, and the length of the auxiliary surface is in a range of about 40% to 70% of the total length of the brace. In this case, the phrase "transversely with respect to the longitudinal direction" is understood to mean that as seen in the longitudinal direction of the crane girder the main surface extends to the right and left and extends in an ascending or descending manner. In particular, the buckling strength of the flat-shaped braces and thus also of the crane girder of a corresponding bridge or gantry crane is optimised or improved when the flat-shaped braces each have the above-described planar main surface that extends in each case transversely with respect to a longitudinal direction of the crane girder. In this case, the supporting elements of a truss construction, which have an oblique or diagonal progression, are considered in general as braces. The braces of a truss construction differ thereby from the supporting elements that extend exclusively in a vertical manner and are designated as posts. Moreover, the flat-shaped braces or surface braces preferably absorb forces in the direction of their longitudinal axis and thus in the extension plane of their planar main surface. Such surface elements or surface supporting structures are designated in technical mechanics as disks, whereas surface elements that are loaded perpendicularly with respect to their extension plane or main surface are designated as plates. Disks and therefore also the inventive surface braces differ, for example, from bars or bar-shaped posts and braces, in that their thickness dimensions are substantially smaller than the length and width dimensions that determine the two-dimensional extent of the disk. Accordingly, inventive flat-shaped braces can also be designated as surface braces or disk braces.

According to other aspects, and in contrast to conventional crane girders in a box girder design, the improved crane girders are characterised in particular by a reduction of the manufacturing outlay and diversity of parts. Moreover, the crane girders that are produced with the inventively flat-shaped braces as trusses have a considerably reduced intrinsic weight and at the same time optimised or improved load-bearing capacity as a result of the omission of statically not required metal sheet regions and a reduction in material associated therewith. Unlike in the case of conventional braces that are designed as bar-shaped rolling profiles, the dimensions, in particular the length and the width of the main surface extending transversely with respect to the longitudinal direction of the crane girder, of an inventive flat-shaped brace can be freely selected by corresponding selection of the metal sheet thickness. In contrast thereto, the conventional rolling profiles that are designed, for example, as U-, L- or T-shaped profiles can only be obtained in accordance with standard series with fixed dimensions and strengths, so that, for example, in the case of a desired brace width the further dimensions of the rolling profile are fixed and cannot be freely selected.

In the case of the crane girders that are improved in accordance with the invention, the risk of buckling of individual crane girder regions can be reduced to a particular extent through the use of flat-shaped braces.

According to another aspect, the aforementioned advantages are increased further by virtue all of the braces being designed having a flat shape. Therefore, in contrast to conventional truss constructions, all individually adapted, bar-shaped braces can be replaced by uniformly designed, inventive flat-shaped braces. This results in a considerable manufacturing advantage as the upper and lower booms of the crane girder are positioned or spaced apart by the braces in accordance with the invention. In particular, it is no longer necessary to individually orient a plurality of bar-shaped braces that are arranged next to one another as seen transversely with respect to the longitudinal direction of the crane girder, since as seen transversely with respect to the longitudinal direction of the crane girder only one brace in accordance with the invention is arranged, which extends correspondingly in terms of its surface in a transverse manner with respect to the longitudinal direction. The bar-shaped braces that, in the case of conventional trusses, are arranged transversely with respect to the longitudinal direction in parallel next to one another, are thus represented by a single flat-shaped brace.

Optionally, the main surfaces of the braces extend over at least half the width of the crane girder.

The manufacturing outlay may be reduced to a particular extent by producing each flat-shaped brace from a laser-cut steel sheet.

In an ideal truss, the bars are mounted in an articulated manner, so that only tensile and compressive forces can be absorbed. In real truss constructions, such as the crane girder in accordance with the present invention, gusset plates are used to transfer any bends in the bars and to distribute the forces so that minimal tension peaks occur. Nevertheless, these gusset plates tend only to have fatigue strength for finite life. Particular problems are posed by situations with the truss, in which centroidal axes of the bars do not coincide at a gusset plate. In this case, secondary bends are produced, which have to be absorbed by the gusset plates.

By reason of its main and auxiliary surfaces, the present invention avoids the disadvantage of a gusset plate, in which by means of targeted weakening of the diagonal brace at risk of bending in the region of the brace ends, which are clamped by being welded to the upper and lower boom, a planar, resilient "plate joint", which can also be designated as a membrane joint is formed. This membrane joint also elastically absorbs the secondary bends. The membrane joint does not require any further structural outlay and considerably increases the service life of the truss because no structural geometric notches are present, which can lead to increases in tension.

This construction also renders it possible, in the case of a bridge crane for changing the length of the various span widths, to vary the gaps between the diagonal braces. As a result, it is possible to change the length of the crane girders in a simple manner.

In contrast to conventional braces that are designed as standardised rolling profiles, the structure of the braces can be freely configured by corresponding laser-cutting.

Optionally, a structurally simple design may be enhanced by virtue of the braces, as seen in the direction of their longitudinal axis, having an L-, U- or Z-shaped cross-section as seen at the level of their auxiliary surfaces. The aforementioned cross-sections are particularly advantageous for high buckling strength of the flat-shaped braces.

In another aspect, it is also provided that lower and upper recesses are provided in the main surfaces of the braces on their longitudinal sides and an aperture is provided on their lower narrow side, which are arranged in each case in the region of a first and/or second brace end. Consequently, with regard to the welding of the braces to upper and lower booms of the crane girder, the force flow is optimised by the welded braces and the weld seams or the weld seam run-outs are relieved. When used outdoors, the aperture allows any rainwater that may accumulate to flow away.

Simple assembly of the braces may be achieved in particular by arranging the auxiliary surfaces between the lower and upper recesses.

According to further aspects, a bridge crane or gantry crane that is designed in a particularly advantageous manner in terms of construction and manufacturing is achieved when the crane girder includes at least one upper boom, which extends in a linear manner in the longitudinal direction thereof, and at least one lower boom arranged in parallel therewith, wherein the upper boom and the lower boom are connected to one another by means of a plurality of braces arranged along the longitudinal direction of the crane girder.

Optionally, the risk of the upper boom or lower boom buckling may be reduced in a particularly effective manner by connecting the upper boom and the lower boom to one another by means of a plurality of posts arranged along the longitudinal direction of the crane girder.

The aforementioned advantage may be enhanced still further by arranging each post next to at least one brace, wherein each brace forms with the corresponding post a setting angle of the same size.

According to still further aspects, an increase in the load bearing capacity of a corresponding bridge crane or gantry crane or the crane girder thereof is achieved when the posts, in a similar manner to the braces, are designed having a flat shape.

In an advantageous manner, it can also be provided that the crane includes two crane girders that are arranged in parallel and at a spaced interval from one another.

The manufacturing outlay can be reduced in particular by fastening the flat-shaped braces and posts to the upper boom and the lower boom by means of weld seams, wherein the weld seams are arranged exclusively on the longitudinal sides of the respective main surfaces. This is possible in particular when the auxiliary surfaces do not extend as far as to the brace feet. By welding the longitudinal sides of the unfolded main surfaces, the connections on the longitudinal sides that are thus established with the corresponding limbs of the upper or lower boom form a type of membrane joint above the brace feet inserted between the limbs and below the folded auxiliary surfaces.

In order to minimise or reduce the manufacturing outlay, it can also be provided that the upper boom and the lower boom each have mutually facing limbs and the braces and the posts are welded exclusively to the inner sides of the limbs.

These and other objects, advantages and features of the invention will become apparent upon review of the following specification in conjunction with the drawings.

DESCRIPTION OF THE PREFERRED EMBODIMENTS

Figure 1A:
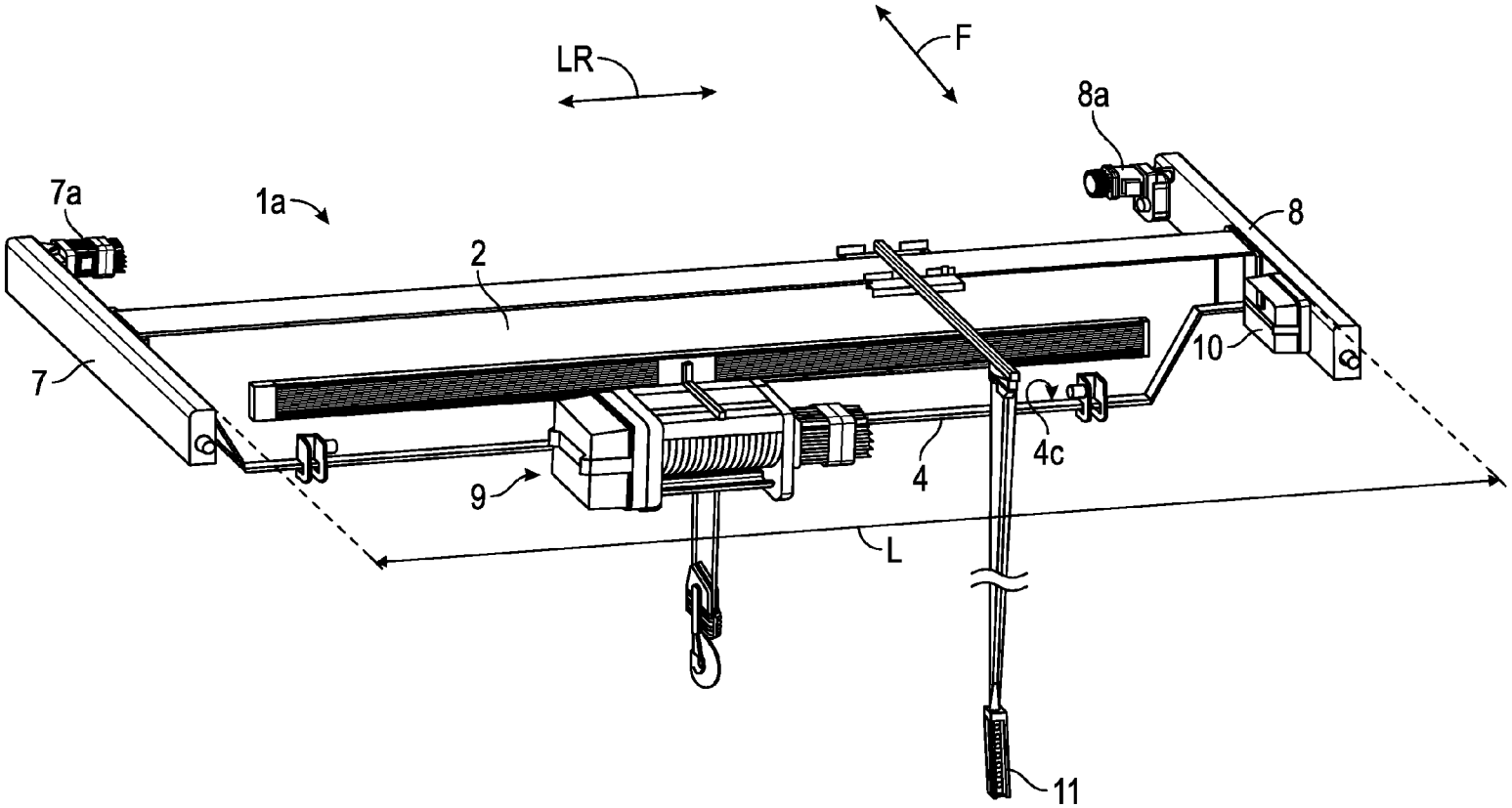
FIG. 1*a* is a top perspective view of a prior art bridge crane designed as a single-girder crane.

Referring now to the drawings and the illustrative embodiments depicted therein, a conventional first crane 1*a* is designed as a single-girder bridge crane (FIG. 1*a*). The first crane 1*a* includes a crane girder 2 that is designed as a box girder, is oriented horizontally and extends with a length L in its longitudinal direction LR. Fastened to opposite ends of the crane girder 2 are first and second travelling mechanisms 7, 8, so that a crane bridge which, in plan view, is substantially double-T-shaped is formed. By means of the travelling mechanisms 7, 8, the first crane 1*a* is movable on rails, not illustrated, in a horizontal direction of travel F transversely with respect to the longitudinal direction LR of the crane girder 2. The rails are typically arranged at a position above the ground and for this purpose can be elevated, for example, by means of a suitable support structure or can be fastened to opposite walls of a building. In order to move the first crane 1*a* or its crane girder 2, the first travelling mechanism 7 is driven by a first electric motor 7*a* and the second travelling mechanism 8 is driven by a second electric motor 8*a*. Suspended from the crane girder 2 is a crane trolley 9 having a lifting gear designed as a cable winch, the crane trolley being movable by means of travelling mechanisms, not illustrated, transversely with respect to the direction of travel F of the first crane 1*a* and along the longitudinal direction LR of the crane girder 2. The crane trolley 9 is movable along and on laterally protruding running surfaces 4*c* of a lower boom 4 of the crane girder 2. The first crane 1*a* also includes a crane controller 10 and a pendant control switch 11 that is connected thereto and by means of which the first crane 1*a* or the electric motors 7*a*, 8*a* and the crane trolley 9 having the cable winch can be controlled and operated separately from one another.

Figure 1B:
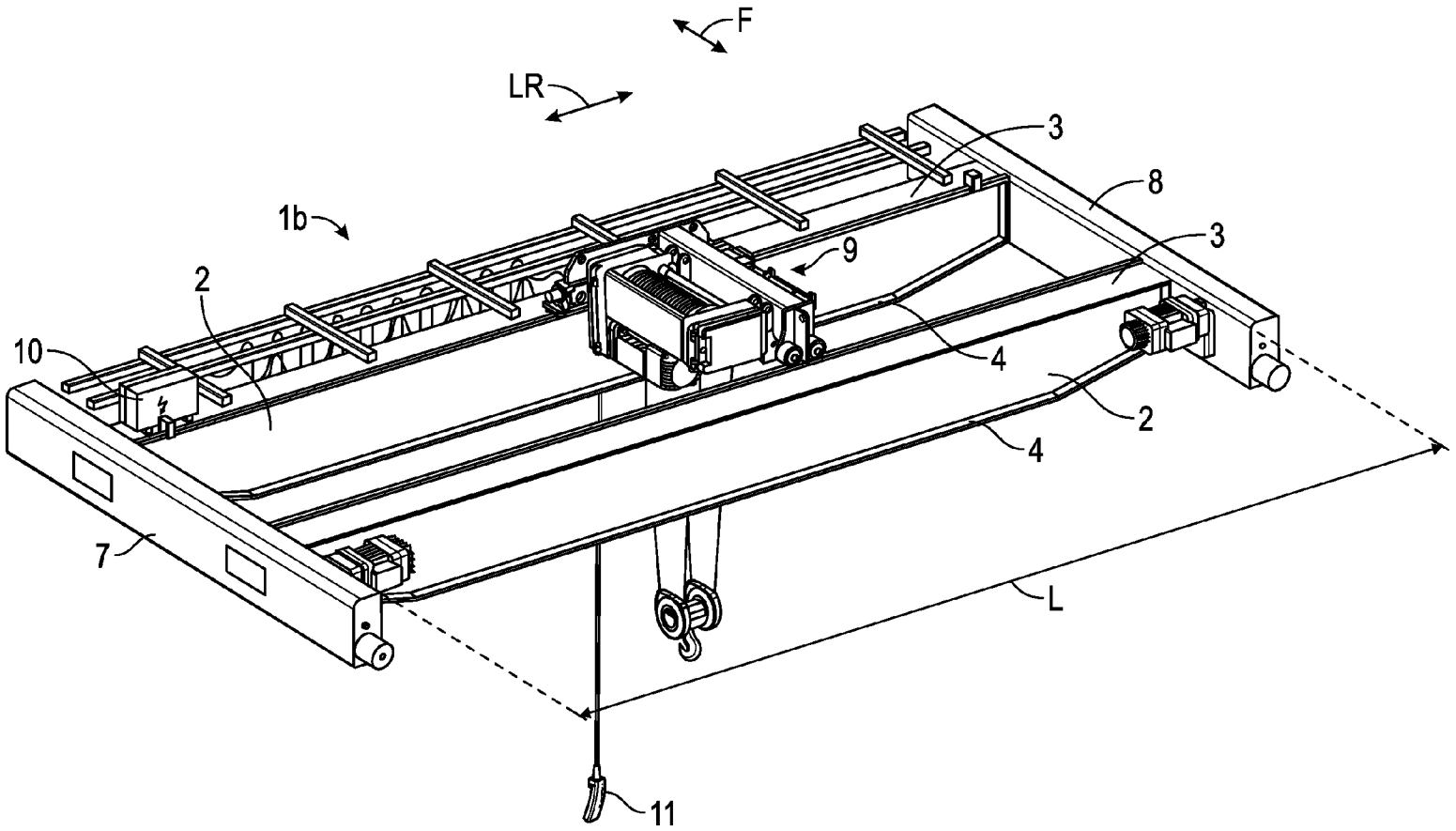
FIG. 1*b* is a top perspective view of another prior art bridge crane designed as a double-girder crane.

A conventional second crane 1*b* is designed as a double-girder bridge crane and which, in contrast to the first crane 1*a* designed as a single-girder bridge crane, includes two crane jibs 2 (FIG. 1*b*). Fastened to the ends of the two crane girders 2 are, again, travelling mechanisms 7, 8, so that a frame is formed as seen in plan view. The second crane 1*b* also includes a crane trolley 9 having a lifting gear designed as a cable winch. However, the crane trolley 9 is not suspended from the lower booms 4 of the crane girders 2, but rather runs on upper booms 3 of the two crane girders 2. Accordingly, the crane trolley 9 arranged centrally between crane girders 2 can be moved along the longitudinal direction LR of the crane girders 2 and between the two crane girders 2. In this case, a load picking-up means of the cable winch arranged on the crane trolley 9 can be lowered or raised between the two crane girders 2.

For the remainder, the statements made with respect to the first crane 1*a* apply accordingly to the second crane 1*b*. Although like reference numerals are used in some cases to describe a conventional box girder and related components as in FIGS. 1*a* and 1*b*, and also to describe the inventive truss girder and related components as in FIGS. 2*a*-4*b*, it will be understood with reference to the drawings and the following descriptions that the truss girders 2 of the present invention are intended to substitute for the conventional box girders 2 of the cranes 1*a*, 1*b* of FIGS. 1*a* and 1*b*. It will further be appreciated the explanations given hereinafter with reference to bridge cranes also apply accordingly to gantry cranes.

Figure 2A:
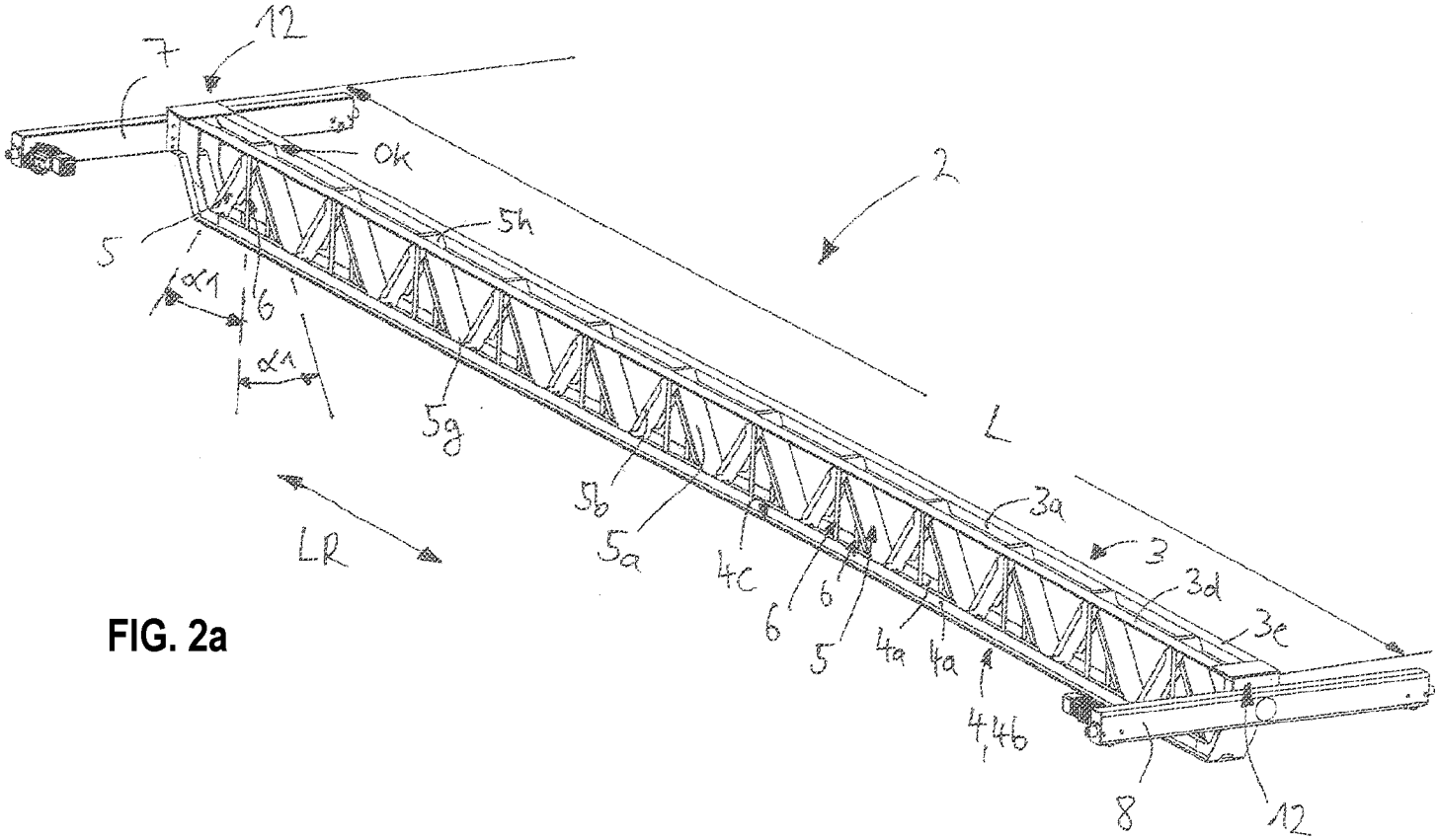
FIG. 2*a* is a top perspective view of a crane girder in accordance with the present invention, for a bridge crane generally in accordance with FIG. 1*a;*

In the illustrated embodiment of FIG. 2*a*, a crane girder 2 is provided for use with a crane 1*a* designed in accordance with FIG. 1*a* as a single-girder bridge crane. In this case, the crane girder 2 is not designed conventionally as a box girder (as in the girders 2 of FIGS. 1*a* and 1*b*), but rather as a truss.

The truss construction of the crane girder 2 includes an upper boom 3, a lower boom 4, diagonally extending braces 5 and vertical posts 6 (FIG. 2*a*). The upper boom 3 and the lower boom 4 extend in each case linearly, in parallel and spaced apart from one another in the longitudinal direction LR of the crane girder 2 between the travelling mechanisms 7, 8. In this case, the upper boom 3 and the lower boom 4 are spaced vertically apart from one another. The upper boom 3 is composed of two first and second upper boom profiles 3*d*, 3*e* that are arranged in a horizontal plane and are spaced horizontally apart from one another.

The two upper boom profiles 3*d*, 3*e* are formed by an L- or angle-profile girder. The lower boom 4 is formed by a flat profile 4*b* having two vertically upstanding limbs 4*a*, so that approximately a U-profile-shaped cross-section is provided. In this case, the flat profile 4*b* is extended laterally beyond the limbs 4*a* (see also FIG. 3). The lateral extensions of the flat profile 4*b* each form a running surface 4*c* for travelling mechanisms of the crane trolley 9. The spaced interval—as seen in the longitudinal direction LR—between the outermost edges of the upper boom profiles 3*d*, 3*e* or of the flat profile 4*b* also produces a width B of the crane girder 2.

The upper boom 3 and the lower boom 4 are connected to one another by means of a plurality of braces 5 designed having a flat shape and a plurality of posts 6 that are bar-shaped in one embodiment. In this case, the braces 5 are formed as a sheet metal profile having a main surface 5*a* with a substantially rectangular cross-section, wherein the longitudinal sides thereof are folded back at least in a central region in the form of auxiliary surfaces 5*b* in order to increase buckling strength.

The truss construction of the crane girder 2 is terminated at the opposite ends of the upper boom 3 and of the lower boom 4 by means of an adapter 12 in each case. By means of these adapters 12, the upper boom 3 and the lower boom 4 are connected to form a frame. Since the lower boom 4 is, on the whole, shorter than the upper boom 3, the adapter 12 has a diagonal progression and the frame of the crane girder 2 is, on the whole, extended from the bottom to the top and is formed in a trapezoidal manner. Moreover, the adapter 12 includes, in the region of the upper boom 3 and on the side facing away from the upper boom 3, a connection plate 12*a*, to which one of the travelling mechanisms 7, 8 or the girder thereof is fastened.

Starting from one of the two adapters 12 as seen in the longitudinal direction LR of the crane girder 2, a first brace 5 is connected to the lower boom 4 and extends in the longitudinal direction LR at a first setting angle $\alpha 1$ inclined in the direction of the upper boom 3 and is fastened at this location in an upper node point OK. In this case, the first setting angle $\alpha 1$ is formed by the first brace 5 and a post 6, which ends in the upper node point OK. Preferably, the first setting angle $\alpha 1$ is in a range of about 35° to 55° and in a particularly preferred manner is about 45°. Then, adjoining in the upper node point OK is a second brace 5, which extends obliquely at the setting angle $\alpha 1$ downwards to the lower boom 4. This is repeated until the opposite end of the crane girder 2 is reached by the braces 5. In this case, an even number of braces 5 is always used, so that the last brace 5 ends at the lower boom 4. Depending upon the length L of the crane girder 2, the setting angle $\alpha 1$ is determined prior to assembly, so that an even number of braces 5 each having the same length and at the same setting angle $\alpha 1$ is used. Moreover, in the region of each upper node point OK, a post 6 is additionally also fastened, which extends vertically with respect to the lower boom 4 and is fastened at this location. As a consequence, the lower boom 4 that is used as a rail and for this purpose forms the running surface 4*c* is reinforced to prevent bending.

The braces 5 are oriented within the truss construction of the crane girder 2 in such a manner that in each case their main surface 5*a* extends transversely with respect to the longitudinal direction LR of the crane girder 2. Moreover, the braces 5 are arranged with their lower first brace ends 5*g* between the upwardly pointing limbs 4*a* of the lower boom 4. At their upper second brace ends 5*h*, the braces 5 are arranged between the two upper boom profiles 3*d*, 3*e*, wherein the upper boom profiles 3*d*, 3*e* are welded to the braces 5 with the inner sides of their limbs 3*a* that are vertically oriented flush with the limbs 4*a* of the lower boom 4 (see FIG. 3). The bar-shaped posts 6 are also arranged between the limbs 4*a* of the lower boom 4 and the limbs 3*a* of the upper boom profiles 3*d*, 3*e* and are welded with the inner sides thereof. For instance, as seen transversely with respect to the longitudinal direction LR of the crane girder 2, only ever one brace 5 is arranged between the limbs 3*a*, 4*a* of the upper boom 3 or lower boom 4.

Furthermore, it is apparent with reference to FIG. 2*a* that in each case two vertical posts 6 are arranged between two braces 5 that extend obliquely or diagonally in the manner of a pitched roof. The braces 5 and posts 6, which are allocated to each other in this manner, meet one another at a common node point OK on the upper booms 3, wherein each brace 5 forms, together with the associated post 6 in the region of the corresponding upper node point OK on the upper booms 3, a first setting angle $\alpha 1$ of the same size. Therefore, by reason of the even number of braces 5 arranged accordingly in pairs the last brace 5 descends towards the lower boom 4 at both ends of the crane girder 2.

Furthermore, the crane girder 2 can be adjusted in a dimensionally accurate manner to the length L by means of adapters 12 (see also FIG. 4), in that the adapters 12 are slid onto the opposite ends of the upper boom 3 of the crane girder 2, are then displaced accordingly in the longitudinal direction LR of the crane girder and finally are welded to the crane girder 2.

Figure 2B:
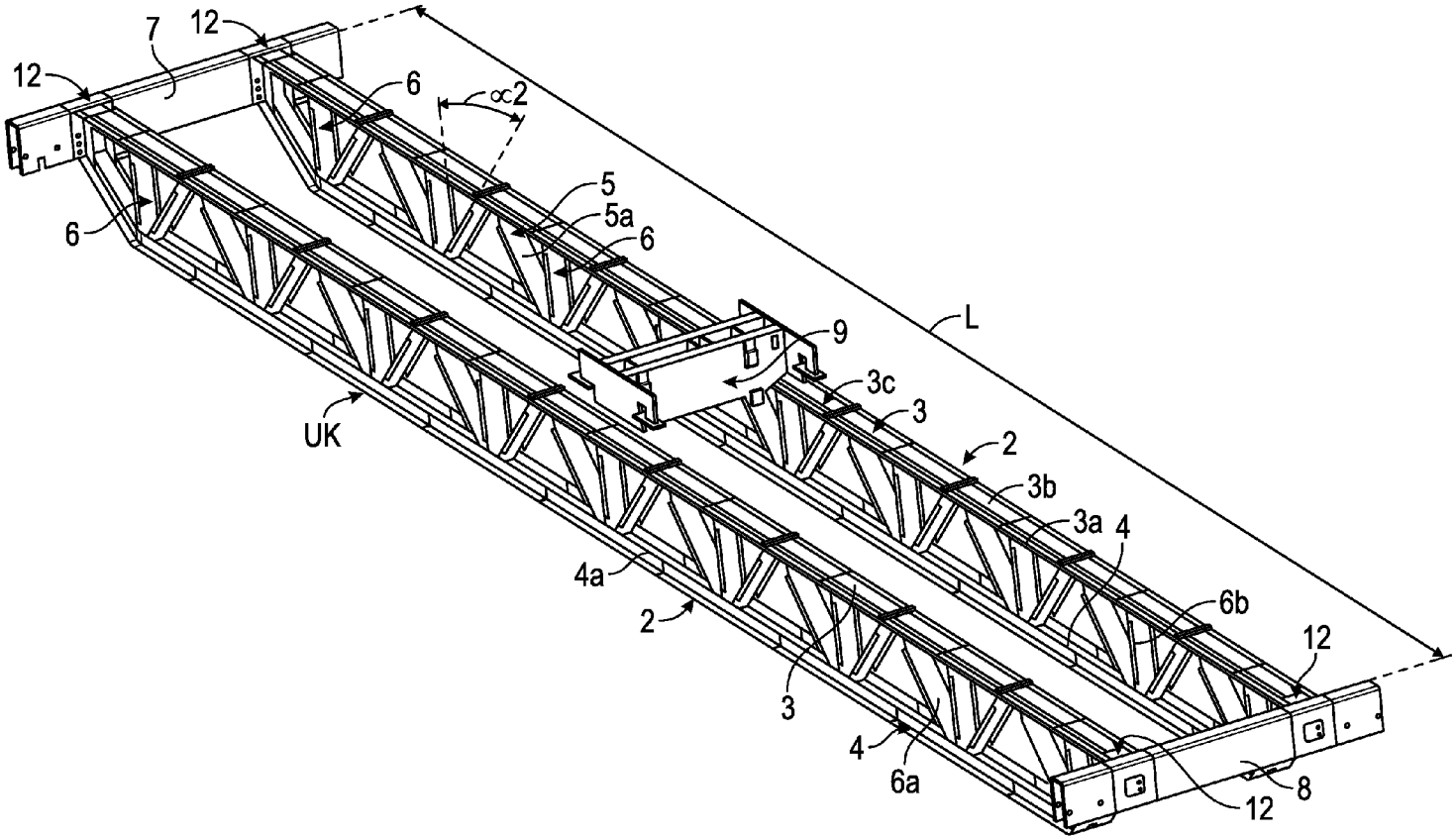
FIG. 2*b* is a top perspective view of two crane girders in accordance with the present invention, for a bridge crane generally in accordance with FIG. 1*b;*

Optionally, and with reference to FIG. 2*b*, two crane girders 2 are designed in accordance with the invention as trusses, for a crane 1*b* designed in accordance with FIG. 1*b* as a double-girder bridge crane. Both crane girders 2 are adjusted to the desired length L by means of adapters 12 slid on at their opposite ends (see also FIG. 4), and are arranged spaced apart from one another in parallel. The travelling mechanisms 7, 8, which are also illustrated, are fastened to the ends of the two crane girders 2 by means of the adapters 12.

The truss construction of the two crane girders 2 of the second crane 1*b* comprise, again, a lower boom 4 and an upper boom 3 longer than the lower boom, the booms being designed in each case in one piece in the same way as the lower boom 4 of the first crane 1*a*. Accordingly, the upper boom 3 of each crane girder 2 is also formed by a flat profile 3*b* having limbs 3*a* with an approximately U-profile-shaped cross-section. The downwardly directed limbs 3*a* of the flat profiles 3*b* of the upper booms 3 and the upwardly directed limbs 4*a* of the flat profiles 4*b* of the lower booms 4 face towards one another.

The upper boom 3 of each crane girder 2 is connected to the associated lower boom 4 by means of a plurality of braces 5 designed having a flat shape and by means of a plurality of posts 6 which, in a second embodiment, are also designed having a flat shape and are vertically oriented. The basic structure of the flat-shaped posts 6 that are formed in this second embodiment corresponds—with correspondingly adapted dimensions—substantially to the structure of the flat-shaped braces 5. However, instead of two bar-shaped posts 6 only one flat-shaped post 6 is arranged between two adjacent braces 5. In this case, each post 6 that is formed in the flat-shaped second embodiment extends with a main surface 6*a* transversely with respect to the longitudinal direction LR of the crane girder 2 and with auxiliary surfaces 6*b* that are folded at a right angle thereto in this longitudinal direction LR. The flat-shaped posts 6 can also be arranged or oriented in such a manner that the auxiliary surfaces 6*b* point towards, or away from, one of the ends of the crane girder 2.

However, it is fundamentally also possible to provide the crane girders 2 of the first crane 1*a*, which is designed as a single-girder crane, with the flat-shaped posts 6 formed in the second embodiment.

The braces 5 are identical for the two crane girders 2 of the second crane 1*b*, i.e., they are formed as in the case of the first crane 1*a* in accordance with FIG. 1*a* in a mirror-symmetrical manner in relation to their longitudinal axis LA.

Moreover, it is indicated in FIG. 2*b* that the crane trolley 9 for the cable winch, not illustrated, is not suspended from the lower booms 4 of the crane girders 2 but rather from lower booms 3 thereof. For this purpose, a running rail having a corresponding running surface 3*c* is provided, preferably centrally, on each of the two upper booms 3, so that the crane trolley 9 is arranged between the crane girders 2 and accordingly, as illustrated in FIG. 1*b*, is movable in the longitudinal direction LR between the travelling mechanisms 7, 8 of the second crane 1*b*.

Braces 5 are arranged in the manner of pitched roof (FIG. 2*b*) in substantially the same way as in the case of the crane girder 2 illustrated in FIG. 2*a*. However, in this case two adjacent braces 5 are allocated only one post 6 designed having a flat shape, such that the braces 5 and the post 6 meet one another at a common lower node point UK on the lower booms 4. Therefore, each brace 5 forms, together with the associated flat-shaped post 6 in the region of the corresponding lower node point UK on the lower booms 4, a second setting angle $\alpha 2$ of the same size which, just like the first setting angle $\alpha 1$, is preferably in a range from about 35° to 55°, and in a particularly preferred manner is about 45°. Therefore, by reason of the even number of braces 5 arranged accordingly in pairs the last brace 5 descends towards the lower boom 4 at both ends of the crane girder 2. However, in contrast to the crane girder 2 illustrated in FIG. 2*a*, a flat-shaped post 6 is also arranged at each end of the crane girder 2 after the last brace 5.

Figure 3:
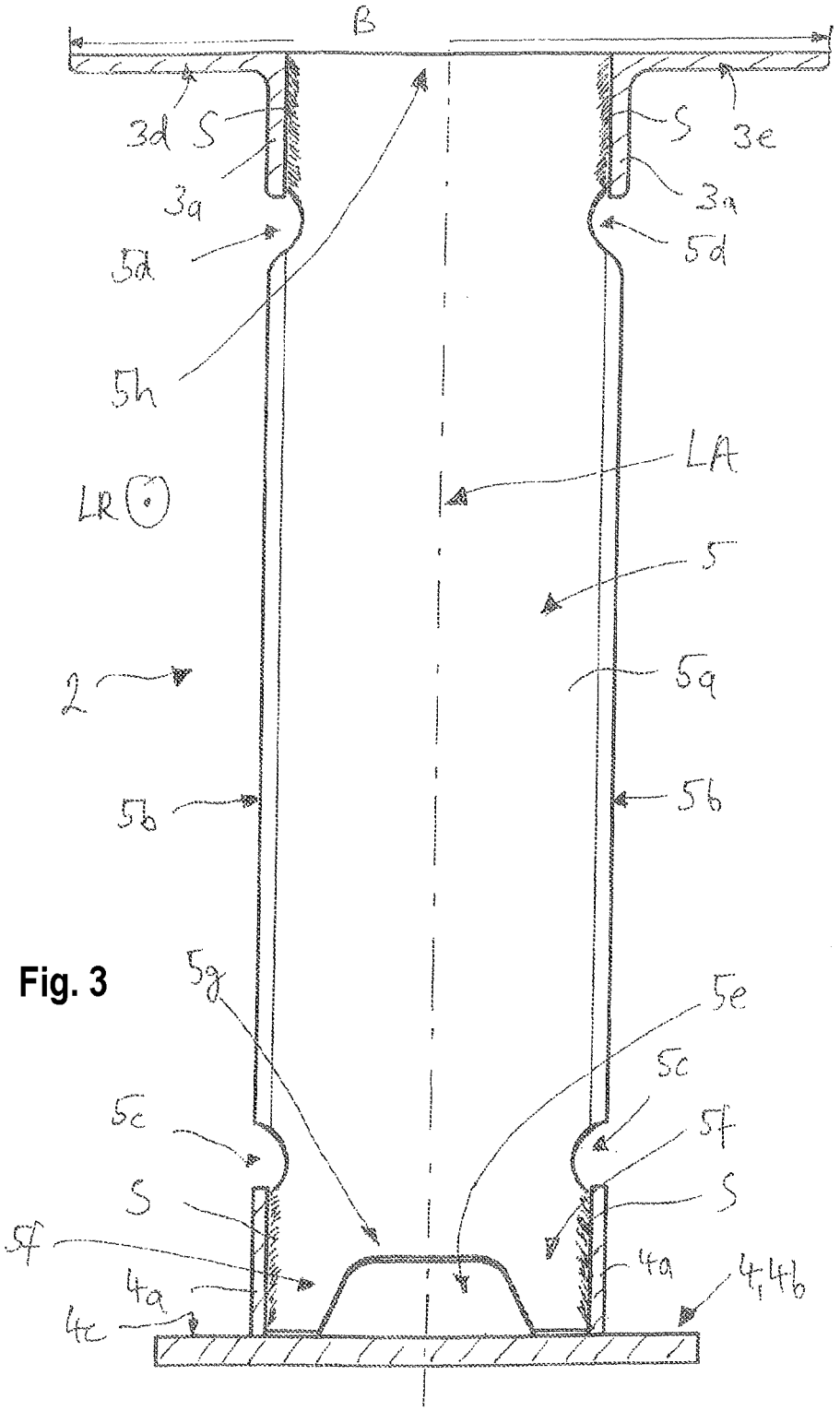
FIG. 3 is a cross-sectional view of the crane girder of FIG. 2*a;*

FIG. 3 illustrates a cross-sectional view of the crane girder 2 in accordance with FIG. 2*a*. Referring now to FIG. 3, the basic structure of the braces 5 corresponds substantially to the fundamental structure of the posts 6 which, in the second embodiment, are likewise designed having a flat shape, but can differ therefrom in terms of dimensions. Accordingly, the statements made in relation to FIG. 3 also apply to the crane girders 2 illustrated in FIG. 2*b* and to the posts 6 used in this case in the flat-shaped second embodiment. For the sake of simplicity, with respect to the description of FIG. 3 reference is made only to the braces 5; the reference numerals 5*a* to 5*h* mentioned in this case similarly designate the corresponding elements of the flat-shaped posts 6, which are indicated at the same points as reference numerals 6*a* to 6*h*.

The brace 5 designed having a flat shape and illustrated in FIG. 3 includes an elongated shape with a substantially rectangular main surface 5*a*. The main surface 5*a* extends along the longitudinal axis LA of the brace 5 and in each case in a central region over at least half the width B of the crane girder 2 transversely with respect to the longitudinal direction LR of the crane girder 2, in particular over at least half the spaced interval between the inner sides of the limbs 3*a* or the limbs 4*a*. The braces 5 are produced from a steel sheet preferably by means of laser-cutting. Moreover, the braces 5 comprise a lower first and a lower second brace end 5*g*, 5*h*. In particular, two brace feet 5*f* are formed on the lower first brace end 5*g* in the region of the lower corners of the brace 5, in that an aperture 5*e* is provided centrally on the lower first brace end 5*g* in the main surface 5*a*. The aperture 5*e* includes a cross-section which, in relation to the longitudinal axis LA, is mirror-symmetrical and is approximately trapezoidal. The braces 5 are inserted with their lower first brace ends 5*g* between the upwardly pointing limbs 4*a* of the lower boom 4. In this case, the brace feet 5*f* lie with their longitudinal sides of the main surface 5*a*, which extend between the lower recesses 5*c* and the lower first brace end 5*g*, against the inner sides of the limbs 4*a* of the lower boom 4 and are welded to the limbs 4*a*. However, the brace feet 5*f* do not lie on the flat profile 4*b* of the lower boom 4. It can also be seen in FIG. 3 that the two upper boom profiles 3*d*, 3*e* lie with their vertical limbs 3*a* against the corresponding longitudinal sides of the main surface 5*a* that extend between the upper recesses 5*d* and the upper second brace end 5*h*, and that a welded connection is established at this location.

It is likewise feasible for the limbs 3*a*, 4*a* not to be spaced equally apart from one another. Accordingly, the outer longitudinal sides of the brace ends 5*g*, 5*h*, in particular also the brace feet 5*f*, are then also spaced at different distances apart from one another, in order to be able to lie against the limbs 3*a*, 4*a*, which are arranged vertically in a non-flush manner, and to be able to be welded thereto.

In the region of its opposite, lower first and upper second brace ends 5*g*, 5*h*, two lower recesses 5*c* and two upper recesses 5*d* are provided on both longitudinal sides of the brace 5. The lower and upper recesses 5*c*, 5*d* adjoin the limbs 3*a*, 4*a* of the upper and lower booms 3, 4 in each case, in order to relieve the weld seam S or the associated weld seam run-out. The recesses 5*c*, 5*d* are round, preferably circular arc-shaped in formation.

Between the lower and upper recesses 5*c*, 5*d*, an auxiliary surface 5*b* that is folded at right angles and extends in parallel with the longitudinal axis LA adjoins the main surface 5*a* at each longitudinal side of the brace 5. The auxiliary surfaces 5*b* are formed substantially in a trapezoidal manner. By folding both the auxiliary surfaces 5*b* in this same direction, the brace 5 illustrated in FIG. 3 includes, at least in the region of the auxiliary surfaces 5*b*, a U-shaped cross-section as seen in the direction of the longitudinal axis LA of the brace 5. It is likewise feasible for the auxiliary surfaces 5*b* to be folded in opposite directions, so that as seen in the direction of the longitudinal axis LA, a Z-shaped cross-section would be produced at least in part. By omitting an auxiliary surface 5*b* or by providing merely one single auxiliary surface 5*b*, the brace 5 can also comprise in a corresponding manner an at least partially L-shaped cross-section as seen in the direction of the longitudinal axis LA. The buckling strength of the braces 5 is increased by means of the auxiliary surfaces 5*b*. The auxiliary surfaces 5*b* are located outside the limbs 3*a*, 4*a*, so that only the regions of the longitudinal sides of the main surfaces 5*a*, which are not folded back, are welded to the limbs 3*a*, 4*a*.

In one possible embodiment, the total length of a brace is 890 mm. In this case, the longitudinal sides of the lower first and the upper second brace ends 5*g*, 5*h* have been inserted in each case at an insertion length of 80 mm between the limbs 3*a*, 4*a* of the upper and lower booms 3*a*, 4*a* or are welded to the limbs 3*a*, 4*a* over the length. The spaced interval between the inserted regions of the longitudinal sides and the auxiliary surfaces 5*b*, i.e., the length of the membrane joints formed in this region, is then 100 mm in each case. Accordingly, in relation to the longitudinal axis LA the auxiliary surfaces 5*b* have an auxiliary surface length of 530 mm, i.e., auxiliary surfaces 5*b* extend in their longitudinal direction over the auxiliary surface length of 530 mm.

The auxiliary surface lengths may be in a range of about 40% to 70% of the total length of the brace 5 and the insertion lengths may be in a range of about 5% to 15% of the total length of the brace 5.

Respective adapters 12 (FIG. 4*a*) are arranged at the opposite ends of a crane girder 2 for the first crane 1*a*. The crane girder 2 is designed as a truss having two upper boom profiles 3*d*, 3*e*. A brace 5 is also shown, which is adjusted at the first setting angle $\alpha 1$ with respect to a bar-shaped post 6.

Figure 4A:
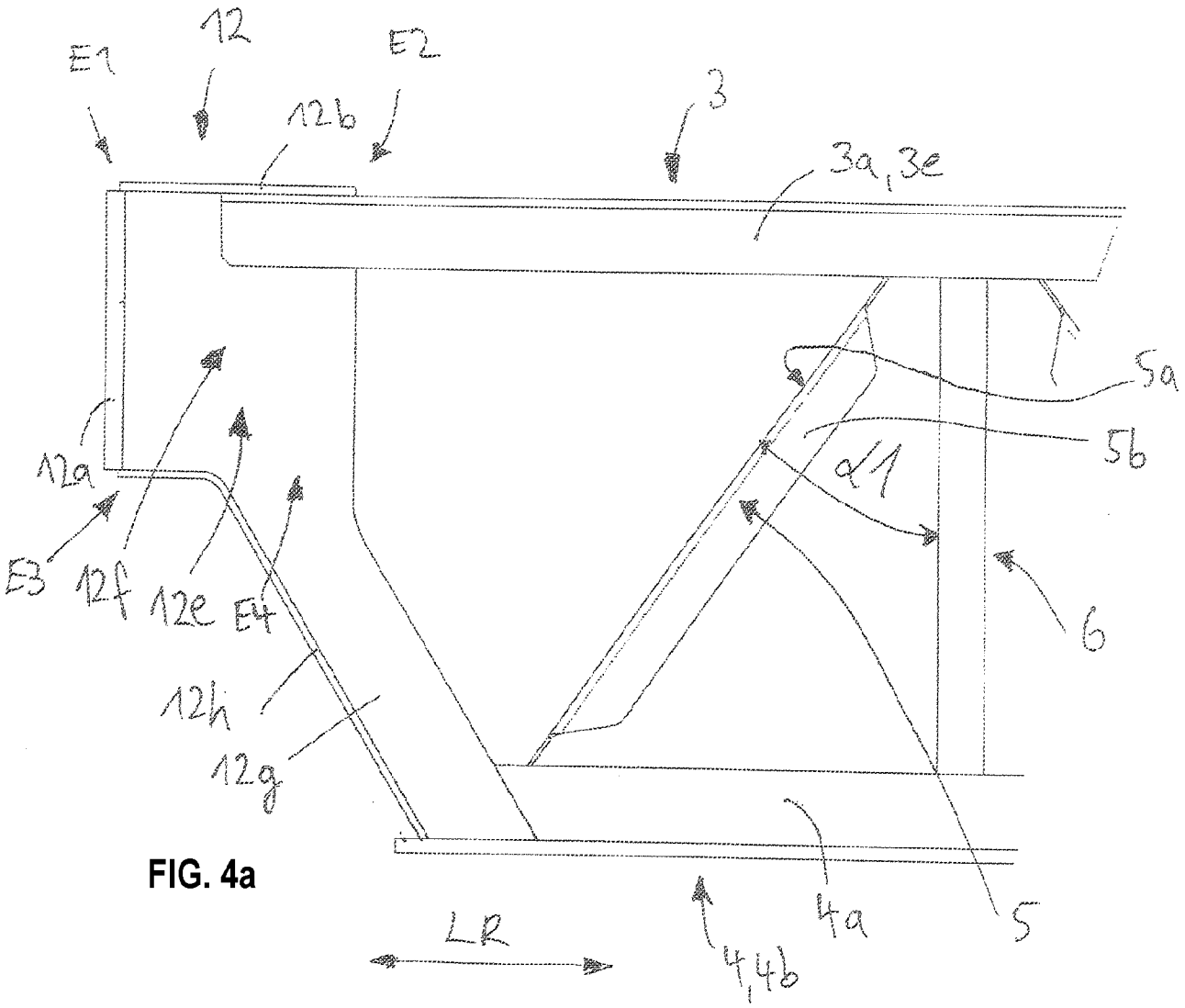
FIG. 4*a* is a side elevation of an adapter at an end of the crane girder.
Figure 4B:
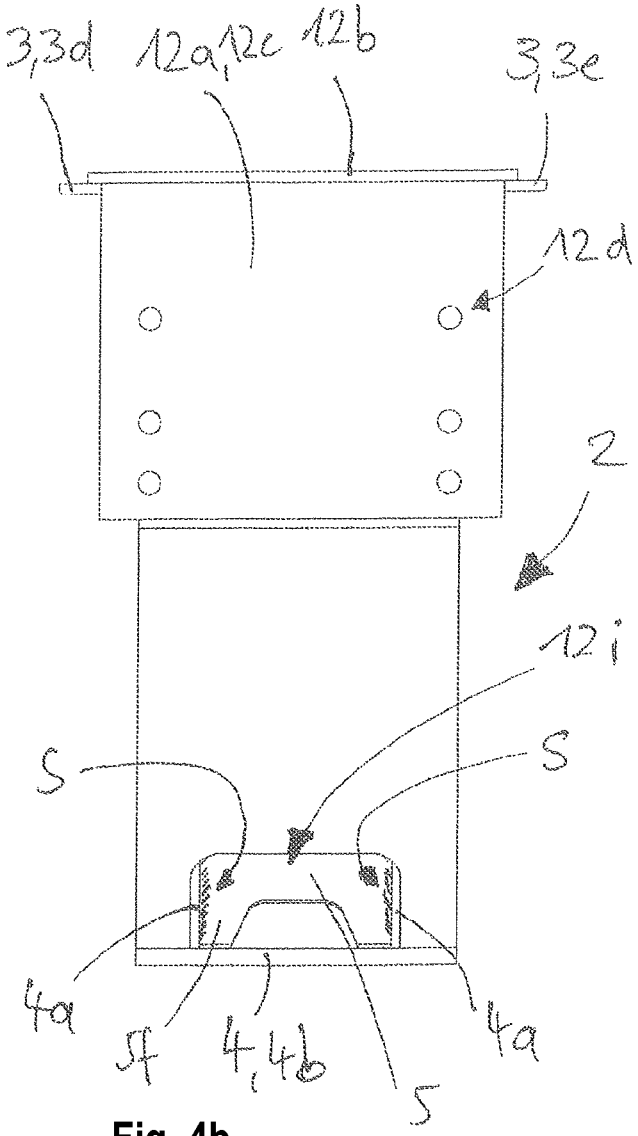
FIG. 4*b* is an end elevation of the adapter as seen in the longitudinal direction of the crane girder.

An auxiliary surface 5*b* of the brace 5 has a trapezoidal formation, which auxiliary surface is folded from the main surface 5*a*, such as shown in FIG. 4*a*. The auxiliary surface 5*b* is arranged outside the limbs 3*a*, 4*a* of the upper and lower booms 3, 4 and extends in a vertical plane that includes the longitudinal direction LR of the crane girder 2.

In order to adjust the desired length L of the crane girders 2, the adapter 12 is placed against the upper boom 3 and the lower boom 4, is oriented in the longitudinal direction LR and is welded thereto. For each adapter, length dimensions of +/−5 millimeters in the longitudinal direction LR can be achieved. Accordingly, the crane girder 2 already has almost the desired length L prior to attaching the adapters 12. In this case, the construction of the adapter 12 is selected such that for the purpose of fine-adjustment of the length L it is displaceable relative to the upper boom profiles 3*d*, 3*e* and the lower boom prior to welding.

The end of the crane girder 2 illustrated in FIG. 4*a* shows the termination of the truss construction, wherein the two upper boom profiles 3*d*, 3*e* of the upper boom 3 are connected to the lower boom 4 to form a frame. For this purpose, the adapter 12 includes two identically formed rib-like adapter walls 12*e* that extend in the longitudinal direction LR and are connected at their upper and lower ends to the limbs 3*a*, 4*a*. In this case, the adapter walls 12*e* are spaced apart from one another and are arranged in parallel with one another and in parallel with the limbs 3*a*, 4*a* and point with their surfaces correspondingly transversely with respect to the longitudinal direction LR of the crane girder 2.

Each adapter wall 12*e* includes a head part 12*f* that is designed substantially as a rectangular and planar plate and has four corners E1 to E4. At the upper sides of the adapter walls 12*e* that connect the upper first corner E1 and the upper second corner E2, a horizontally oriented head plate 12*b* is placed onto the adapter walls 12*e* and is welded thereto. The head plate 12*b* is formed in a planar and rectangular manner. The vertically oriented connection plate 12*a* is fastened to the connection side of the adapter walls 12*e* that connects the first corner E1 to the third corner E3 arranged vertically therebelow. The connection plate 12*a* is also formed in a planar and rectangular manner, wherein as seen in the longitudinal direction LR, the connection plate 12*a* protrudes laterally beyond the adapter walls 12*e*. The connection plate 12*a* and the head plate 12*b* are thus arranged substantially at right angles with respect to one another and meet one another in the region of the first corner E1. In the region of a fourth corner E4 located diagonally opposite the first corner E1, the head part 12*f* of the adapter walls 12*e* transitions into a connection limb 12*g*. In this case, the connection limbs 12*g* adjoin the head part 12*f* of the respective adapter wall 12*e* in such a manner as to extend diagonally or obliquely downwards directed away from the connection side of the adapter walls 12*e*. The connection limbs 12*g* are formed in a flat and elongate manner and therefore their basic structure resembles substantially the structure of the limbs 3*a*, 4*a* of the upper boom 3*a* or the lower boom 4*a*.

In the case of an adapter 12, which is placed onto the corresponding end of the crane girder 2, the diagonal progression of the connection limbs 12*g* permits the connection to the lower boom 4, which is designed to be shorter than the upper boom 3. In this case, the dimensions of the adapter walls 12*e*, in particular with regard to their head parts 12*f* and their connection limbs 12*g*, are selected in dependence upon the spaced interval between the upper boom 3 and the lower boom 4 such that the connection limbs 12*g* reach the lower boom 4 and in this case lie outside the limbs 4*a* against their outer sides such that they can still be connected or welded laterally to one another. In contrast to the upper and lower booms 3, 4 in FIG. 3, the limbs 3*a* of the upper boom 3 in FIG. 4*a* are thus not aligned in each case in a vertically flush manner with the limbs 4*a* of the lower boom 4, but rather the limbs 3*a* are spaced further apart from one another in the horizontal direction than the limbs 4*a*. Therefore, the connection brace 12*g* (which arrives at the lower boom 4) and the last brace 5 also intersect inside or outside the respective limb 4*a*.

However, it is also possible that the limbs 3*a*, 4*a* are arranged with respect to one another as shown in FIG. 3 and the lower ends of the connection limbs 12*g* are inserted to a corresponding extent between the limbs 4*a* thereof, in order to be able to be connected thereto. Accordingly, the adapter walls 12*e* are arranged to be spaced so far apart from one another that in the region of the head parts 12*f* they lie with their outer sides flat against the inner sides of the limbs 3*a*, 3*b* of the upper boom profiles 3*d*, 3*e* of the upper boom 3 or the lower boom 4 in the same way as they lie against the lower free ends of the connection limbs 12*g*.

It is likewise feasible that when the limbs 3*a*, 4*a* are spaced unequally apart from one another the adapter plates 12 lie with their head parts 12*f* between the limbs 3*a* of the upper boom 3, but lie with their connection limbs 12*g* outside the limbs 4*a* of the lower boom 4 against the outer sides thereof.

In order to ensure that the adapter 12 or its correspondingly mutually spaced-apart adapter walls 12*e*, in particular the connection limbs 12*g* thereof, acquire sufficient rigidity and stability, an end plate 12*h* is provided on the lower sides of the adapter walls 12*e*. The end plate 12*h* extends starting from the third corner E3 of the head part 12*e* in the direction of the fourth corner E4, initially in a horizontal manner and then follows diagonally downwards the progression of the connection limbs 12*e* until it terminates at the lower boom 4. The end plate 12*h* that is bent in this manner is welded to the undersides of the adapter walls 12*e*. Moreover, a substantially rectangular recess 12*i* is provided at one end of the connection plate, which faces away from the head parts 12*f*.

Adaptation to the desired length L of a crane girder 2 can also be effected if in contrast to the illustration in FIG. 4*a*—as for example in the case of the second crane 1*b*—each crane girder 2 includes an upper boom 3 with a flat profile 3*b*. In the case of an upper boom 3 that is designed in one piece as a flat profile 3*b*, the adapter walls 12*e* are set back below the head plate 12*b* to such an extent that the adapter 12 lies only with its head plate 12*b* on the upper boom 3. The adapter walls 12*e* then no longer lie laterally against the limbs 3*a*, 4*a*.

In order to complete the length of the crane girder 2, the adapter 12 is slid onto one end of the crane girder 2, wherein its head plate 12*b* lies flat on the upper sides of the upper boom 3 or the two upper boom profiles 3*d*, 3*e*. The length L that is to be adjusted is defined by connection surfaces 12*c* of the connection plates 12*a* arranged at both ends of the crane girder 2, wherein the connection surfaces 12*c* point in opposite directions away from the upper booms 3. Finally, the length L is adjusted in a dimensionally accurate manner, in that the adapter 12 that lies with the head plate 12*b* on the upper boom 3 is displaced correspondingly in the longitudinal direction LR. In order to fix the length L that is adjusted in this manner, the adapters 12 are then welded to the upper boom 3 and the lower boom 4.

However, it is also possible initially to slide an adapter 12 without a connection plate 12*a* onto the end of the crane girder and to adjust the length L. The connection plate 12*a* is then finally welded thereto, in order to orient the two opposite connection plates 12*a* with one another, as the connection plates 12*a* are already provided with bores 12*d*, by means of which the travelling mechanisms 7, 8 are fastened to the adapters 12 and thus to the corresponding crane girder 2.

The adapter 12, as seen in the longitudinal direction LR of the crane girder 2 (FIG. 4*b*), is slid onto an end of the crane girder 2. It is apparent that the horizontally oriented head plate 12*b* of the adapter 12 lies on the upper boom 3 or its upper boom profiles 3*d*, 3*e*. This is adjoined by the vertically oriented connection plate 12*a* having the bores 12*d* for fastening one of the travelling mechanisms 7, 8. Arranged below the connection plate 12*a* is the end plate 12*h*, on whose end facing towards the lower boom 4 the recess 12*i* is provided. Through the recess 12*i*, it is possible to see a brace 5 that is inserted with its brace feet 5*f* between the limbs 4*a* of the flat profile 4*b* of the lower boom 4. Indicated on the outer longitudinal sides of the brace feet 5*f* is in each case one of the weld seams S, by means of which the brace 5 is fastened to the lower boom 4.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A crane comprising at least one crane girder that extends horizontally and is designed as a truss with a plurality of braces, on which girder a crane trolley with a lifting gear is movable, wherein at least some of the braces are designed having a flat shape, wherein the flat-shaped braces each have a planar main surface that extends in each case transversely with respect to a longitudinal direction of the crane girder, wherein the flat-shaped braces have an elongated shape with longitudinal sides, and comprise in a region of the longitudinal sides of the braces in each case at least one folded auxiliary surface that adjoins the main surface, wherein the at least one auxiliary surface points transversely with respect to the longitudinal direction of the crane girder, the braces having opposite brace ends, wherein lower and upper recesses are provided in the main surfaces of the braces along respective laterally-outboard edges of the longitudinal sides of the braces, wherein the auxiliary surfaces are spaced longitudinally inwardly from the brace ends and between the lower and upper recesses, and wherein the length of the auxiliary surface extending between and outside the brace ends is in a range of about 40% to 70% of the total length of the respective brace.

2. The crane of claim 1, wherein all of the braces of the crane girder are designed having a flat shape.

3. The crane of claim 1, wherein the main surfaces of the braces extend over at least half the width of the crane girder.

4. The crane of claim 1, wherein the braces, as seen in the direction of their longitudinal axes, have an L-, U- or Z-shaped cross-section.

5. The crane of claim 1, further comprising an aperture provided on a lower narrow side of the braces, which narrow side extends between the longitudinal sides of the braces, and which apertures are arranged in each case in the region of a first or second brace end.

6. The crane of claim 1, wherein the crane girder comprises at least one upper boom that extends in a linear manner in the longitudinal direction thereof, and wherein the crane girder further comprises at least one lower boom arranged in parallel with the upper boom, wherein the upper boom and the lower boom are connected to one another by a plurality of the braces arranged along the longitudinal direction of the crane girder.

7. The crane of claim 6, wherein each of the auxiliary surfaces comprises respective opposite ends that are spaced below the upper boom and spaced above the lower boom.

8. The crane of claim 6, wherein the upper boom and the lower boom are connected to one another by a plurality of posts arranged along the longitudinal direction of the crane girder.

9. The crane of claim 8, wherein each of the posts is arranged next to at least one brace, wherein each of the braces forms with the corresponding post a setting angle of the same size.

10. The crane of claim 8, wherein the posts are designed having a flat shape.

11. The crane of claim 1, wherein the crane comprises two crane girders that are arranged in parallel and at a spaced interval from one another.

12. The crane of claim 8, wherein the flat-shaped braces and the posts are fastened to the upper boom and the lower boom by weld seams, wherein the weld seams are arranged exclusively on the longitudinal sides of the respective main surfaces.

13. The crane of claim 8, wherein the upper boom and the lower boom each have mutually facing limbs and the braces and the posts are welded exclusively to the inner sides of the limbs.

14. The crane of claim 1, wherein the crane girder comprises at least one upper boom that extends in a linear manner in the longitudinal direction thereof, and wherein the crane girder further comprises at least one lower boom arranged in parallel with the upper boom, wherein the upper boom and the lower boom are connected to one another by a plurality of the braces arranged along the longitudinal direction of the crane girder.

15. The crane of claim 14, wherein the upper boom and the lower boom are connected to one another by a plurality of posts arranged along the longitudinal direction of the crane girder.

16. The crane of claim 15, wherein each of the posts is arranged next to at least one brace, wherein each of the braces forms with the corresponding post a setting angle of the same size.

17. The crane of claim 16, wherein the posts are designed having a flat shape.

18. The crane of claim 17, wherein the crane comprises two crane girders that are arranged in parallel and at a spaced interval from one another.

19. The crane of claim 18, wherein the flat-shaped braces and the posts are fastened to the upper boom and the lower boom by weld seams, wherein the weld seams are arranged exclusively on the longitudinal sides of the respective main surfaces.

20. The crane of claim 19, wherein the upper boom and the lower boom each have mutually facing limbs and the braces and the posts are welded exclusively to the inner sides of the limbs.

* * * * *